US005501928A

United States Patent [19]

Datta et al.

[11] Patent Number: 5,501,928

[45] Date of Patent: Mar. 26, 1996

[54] METHOD OF MANUFACTURING A LUMINESCENT SCREEN FOR A CRT BY CONDITIONING A SCREEN-STRUCTURE LAYER

[75] Inventors: Pabitra Datta, Cranbury; Eugene S. Poliniak, Willingboro, both of N.J.; Peter M. Ritt, East Petersburg, Pa.; Brian T. Collins, Lancaster, Pa.; Harry R. Stork, Adamstown, Pa.

[73] Assignee: Thomson Consumer Electronics, Inc., Indianapolis, Ind.

[21] Appl. No.: 355,563

[22] Filed: Dec. 14, 1994

[51] Int. Cl.[6] ..... G03C 5/00; H01J 9/38; B65D 3/02; B65D 5/06

[52] U.S. Cl. ..... 430/23; 430/130; 430/132; 427/68; 427/314; 445/38; 445/39; 445/90

[58] Field of Search ..... 445/38, 39, 40; 427/68, 314; 430/23, 28, 29, 130, 132

[56] References Cited

U.S. PATENT DOCUMENTS

| | | | |
|---|---|---|---|
| 3,475,169 | 10/1969 | Lange | 96/1 |
| 4,213,663 | 7/1980 | Nubani et al. | 445/40 |
| 4,327,123 | 4/1982 | Levine et al. | 427/64 |
| 4,707,426 | 11/1987 | Dodds et al. | 430/25 |
| 4,921,767 | 5/1990 | Datta et al. | 430/23 |
| 5,039,551 | 8/1991 | Fujira | 427/68 |
| 5,083,959 | 1/1992 | Datta et al. | 445/52 |
| 5,178,906 | 1/1993 | Patel et al. | 427/64 |
| 5,360,361 | 11/1994 | Bechtel et al. | 445/40 |
| 5,449,573 | 9/1995 | Aoki et al. | 430/132 |

FOREIGN PATENT DOCUMENTS

| | | | |
|---|---|---|---|
| 55-111040 | 8/1980 | Japan | 445/40 |
| 62-131440 | 6/1987 | Japan | 445/38 |
| 3-246854 | 11/1991 | Japan | 430/23 |

*Primary Examiner*—Charles L. Bowers, Jr.
*Assistant Examiner*—J. Pasterczyk
*Attorney, Agent, or Firm*—Joseph S. Tripoli; Dennis H. Irlbeck; Vincent J. Coughlin, Jr.

[57] ABSTRACT

A method of manufacturing a luminescent screen assembly on an interior surface of a faceplate panel 12 for a color CRT 10 includes the steps of uniformly applying a solution of a material to form an organic conductive (OC) layer and overcoating the OC layer with a solution to form an organic photoconductive (OPC) layer, on the interior surface of the faceplate panel. The OPC layer 34 is conditioned by directing a stream of dry gas thereon to warm the OPC layer to a preheat temperature, while maintaining the panel at a panel temperature less than the preheat temperature. The OPC layer is exposed to IR radiation to rapidly increase the temperature of the OPC layer to a curing temperature, greater than the preheat temperature, to remove some of the volatilizable constituents from the OPC layer, without substantially increasing the temperature of the panel. The OPC layer is then cooled by directing at least one stream of cool gas onto the surface thereof, to lower the temperature of the OPC layer to a subsequent processing temperature.

11 Claims, 3 Drawing Sheets

Fig. 1
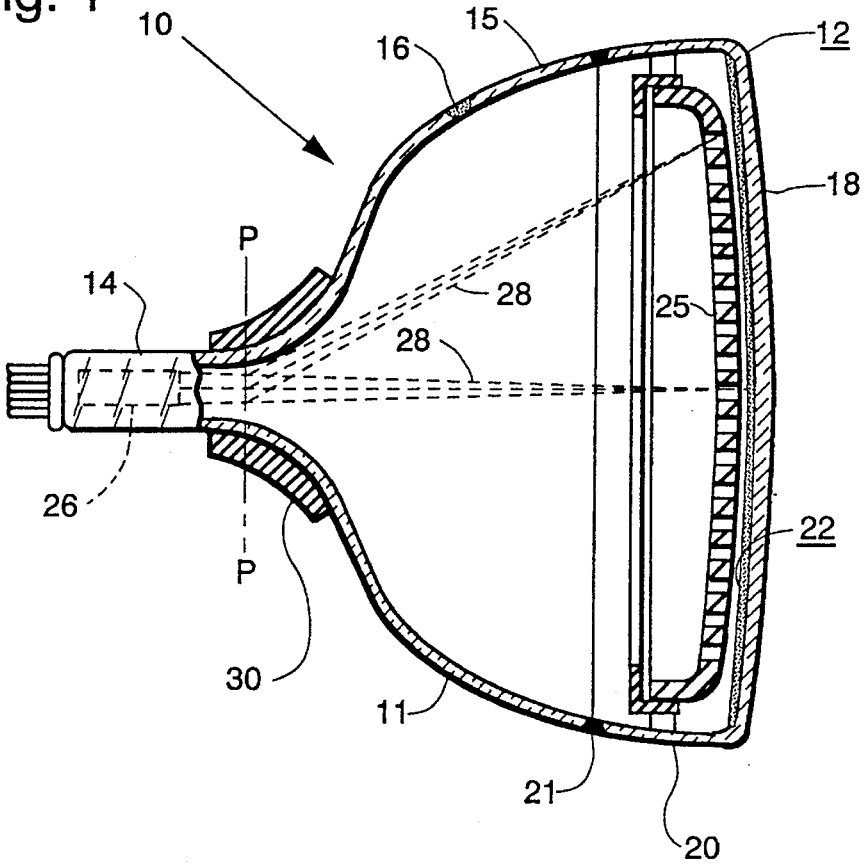
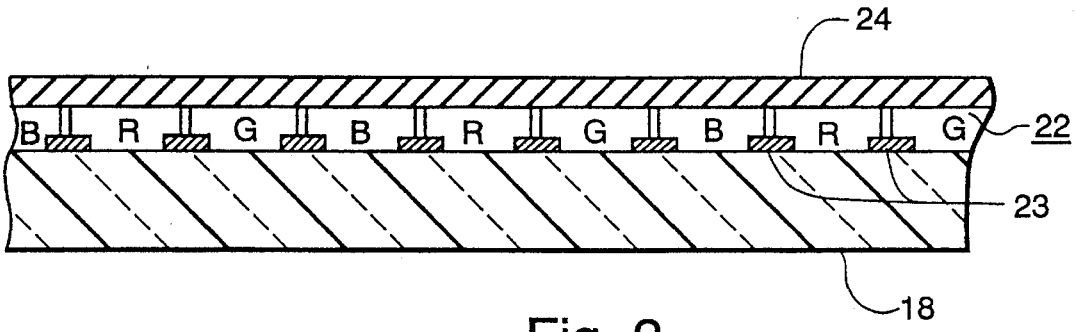
Fig. 2

METHOD OF MANUFACTURING A LUMINESCENT SCREEN FOR A CRT BY CONDITIONING A SCREEN-STRUCTURE LAYER

The present invention relates to a method of manufacturing a luminescent screen assembly on a faceplate panel for a cathode-ray tube (CRT) and, more particularly, to a method of manufacturing a screen assembly in which an organic photoconductive layer is conditioned to accept and retain a subsequently applied electrostatic charge, without substantially heating the faceplate panel.

BACKGROUND OF THE INVENTION

U.S. Pat. No. 4,921,767, issued to Datta et al., on May 1, 1990, describes the basic method of manufacturing a luminescent screen for a color CRT by the electrophotographic screening (EPS) process, using dry-powdered, triboelectrically-charged screen structure materials that are serially deposited onto a suitable photoreceptor disposed on an interior surface of a faceplate panel. The photoreceptor comprises, preferably, an organic conductive (OC) layer having a thickness of about 1 micron (μm) and an overlying organic photoconductive (OPC) layer having a thickness of about 5–6 μm. In the above-referenced patent, the OPC layer is a volatilizable organic polymeric material, such as polyvinyl carbazole, n-ethyl carbazole, n-vinyl carbazole or tetra phenyl butatriene (TPBT), dissolved in a suitable binder, such as polymethyl methacrylate or polypropylene carbonate. In the EPS process, the OPC layer must be suitably dried and the underlying faceplate panel must be cooled to a temperature of about 35° C., or less, in order for the OPC layer to accept and retain an electrostatic charge from a charging device. It is known to dry the OPC layer with a metal rod sheath-heater, but about 30–45 seconds are required to dry the OPC layer by this method. Additionally, this relatively long drying time warms the faceplate glass substantially, and additional time is required to cool the glass and the OPC layer to below 35° C. The relatively long heating and cooling times are not a problem in a laboratory environment; however, such long processing times are incompatible with efficient commercial production, where each step in the process should, ideally, take no more than about 10, and, preferably about 8, seconds for panels with a diagonal dimension of 51 centimeters (cm), or less. The OC layer presents no such problem, because it has an optimum thickness of only about 1 μm and can be air-dried rapidly.

The formulation of the OPC layer recently has been changed from that of the above-referenced patent, to reduce its spectral sensitivity beyond 550 nanometers (nm), so that the screen may be processed in yellow light, rather than in the dark, as required for the prior OPC material. The present OPC layer comprises a solution of polystyrene resin; 2,4-DMPBT as an electron donor material; TNF and 2-EAQ as electron acceptor materials; a surfactant; and a suitable solvent. The improved OPC layer may be applied by spin-coating or spraying the above-described solution onto the interior surface of the faceplate panel. The dried OPC layer, made with the present solution, also has an optimum thickness of about 5–6 μm. However, if the metal rod sheath heaters are used to dry the improved OPC layer, the drying time remains about 30–45 seconds, resulting in the unintended heating of the faceplate panel, thereby requiting additional time to cool the panel to a temperature of less than about 35° C., to facilitate subsequent processing.

In order to provide an OPC layer that readily accepts and retains an electrostatic charge, and is compatible with commercial production cycle times of about 8 seconds, a more efficient method of conditioning the OPC layer 34, without heating the panel 12, is required.

SUMMARY OF THE INVENTION

In accordance with the present invention, a method of electrophotographically manufacturing a luminescent screen assembly on an interior surface of a faceplate panel for a color CRT includes the steps of coating the interior surface of the faceplate panel with a volatilizable, organic conductive solution to form an organic conductive (OC) layer, and overcoating the OC layer with a volatilizable, organic photoconductive solution to form an organic photoconductive (OPC) layer. The method is improved over prior methods by conditioning the OPC layer by directing a stream of dry gas onto the OPC layer to warm the layer to a preheat temperature, while maintaining the panel at a panel temperature less than the preheat temperature. The OPC layer is exposed to IR radiation to rapidly increase the temperature thereof to a curing temperature, greater than the preheat temperature, to remove at least some of the volatilizable constituents from within the OPC layer, without substantially increasing the temperature of the panel. Then, the OPC layer is cooled by directing a stream of cool gas onto the surface of the OPC layer to lower the temperature thereof to a subsequent processing temperature.

BRIEF DESCRIPTION OF THE DRAWINGS

The invention will now be described in greater detail, with relation to the accompanying drawings, in which:

FIG. 1 is a plan view, partially in axial section, of a color CRT made according to the present invention;

FIG. 2 is a section of a faceplate panel of the CRT of FIG. 1, showing a screen assembly;

DETAILED DESCRIPTION OF THE PREFERRED EMBODIMENT

Figure 3:
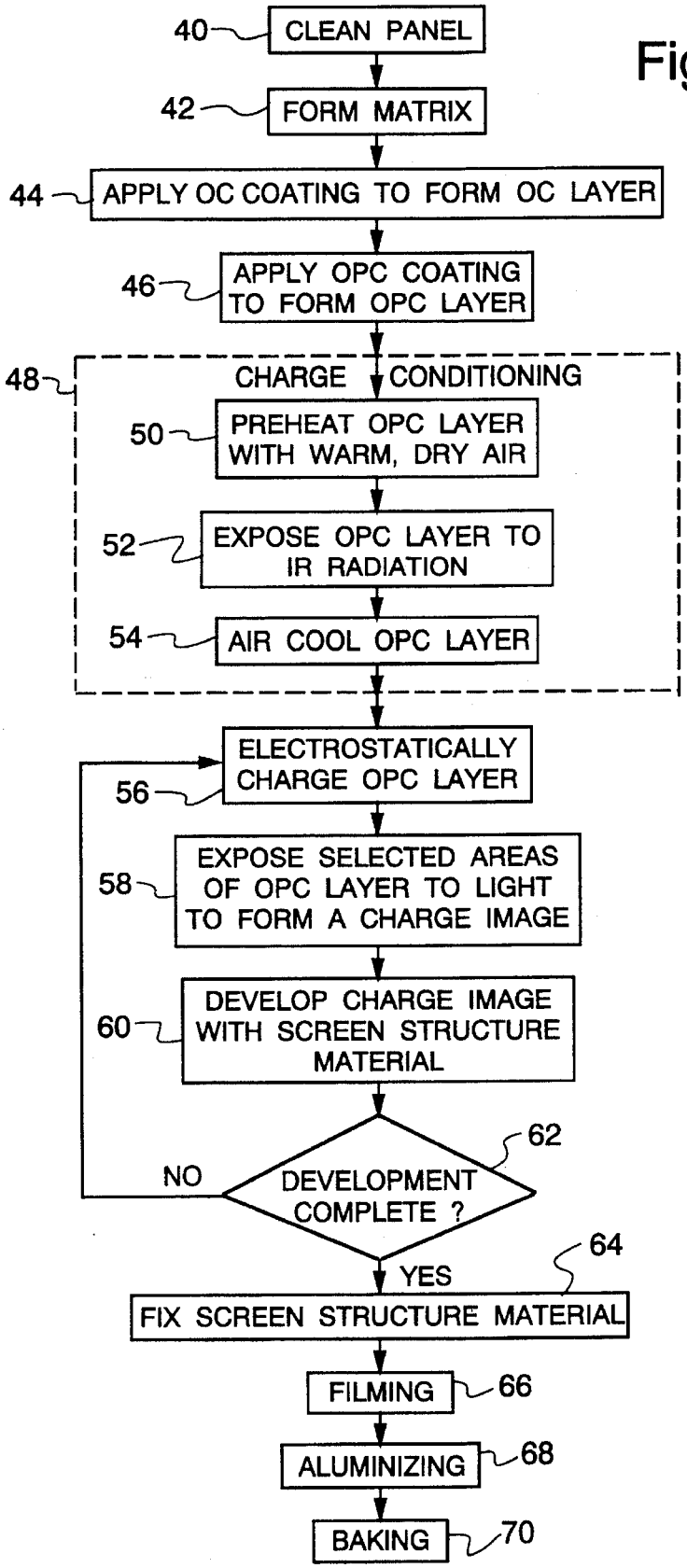
FIG. 3 is a block diagram comprising a flow chart of the manufacturing process involved.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A luminescent three color phosphor screen 22 is carried on the inner surface of the faceplate 18. The screen 22, shown in FIG. 2, is a line screen which includes a multiplicity of screen elements comprised of red-emitting, green-emitting and blue-emitting phosphor stripes R, G, and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction. Portions of the phosphor stripes overlap a relatively thin, light absorptive matrix 23, shown in FIG. 2, that is, preferably, of the type formed by the "wet" process, as described in U.S. Pat. No. 3,558,310, issued to Mayaud on Jan. 26, 1971, or, alternatively, of the type formed by the EPS process in either a single step, as described in the above-cited U.S. Pat. No. 4,921,767, or by the "two step" process described in U.S. Pat. No. 5,229,234, issued to Riddle et at., on Jul. 20, 1993. The "two step" matrix deposition process increases the opacity of the resultant matrix over that of the single step process, so that it has an opacity equivalent to that of the matrix formed by the "wet" process. Also in the alternative, the matrix can be formed by the EPS process after the screen elements are deposited, as described in U.S. Pat. No. 5,240,798, issued to Ehemann, Jr., on Aug. 31, 1993. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

The screen 22 is manufactured by an electrophotographic screening (EPS) process that is shown schematically in FIG. 3. Initially, the panel 12 is cleaned, as indicated at reference numeral 40, by washing it with a caustic solution, rinsing it in water, etching it with buffered hydrofluoric acid and rinsing it again with water, as is known in the art. The interior surface of the viewing faceplate 18 is then provided with the light absorbing matrix 23, as indicated by reference numeral 42, preferably using the conventional wet matrix process described in the above-cited U.S. Pat. No. 3,558,310. In the wet matrix process, a suitable aqueous photoresist solution is applied to the interior surface of the panel 12, e.g., by spin coating, and the solution is dried to form a photoresist layer. Then, the shadow mask is inserted into the panel and the panel is placed onto a three-in-one light house (not shown), which exposes the photoresist layer to actinic radiation from a light source which projects light through the openings in the shadow mask. The exposure is repeated two more times, with the light source located to simulate the paths of the electron beams from the three electron guns of the CRT. The light selectively alters the solubility of the exposed areas of the photoresist layer where phosphor materials subsequently will be deposited. After the third exposure, the panel is removed from the lighthouse and the shadow mask is removed from the panel. The photoresist layer is developed, using water, to remove the more soluble areas thereof, thereby exposing the underlying interior surface of the faceplate, and leaving the less soluble, exposed areas of the photoresist layer intact. A suitable solution of light-absorbing material (not shown) then is provided on the interior surface of the faceplate 18 and uniformly dispersed to cover the exposed portion of the faceplate and the retained, less soluble, areas of the photoresist layer on the panel 12. The layer of light-absorbing material is dried and developed, using a suitable solution which will dissolve and remove the retained portion of the photoresist layer and the overlying light-absorbing material, thereby forming windows in the matrix layer which is adhered to the interior surface of the faceplate. For a panel having a diagonal dimension of 51 cm (20 inches), the window openings formed in the matrix have a width of about 0.13 to 0.18 mm, and the matrix lines have a width of about 0.1 to 0.15 mm.

The interior surface of the faceplate 18, having the matrix 23 thereon, is then uniformly coated with a suitable volatilizable, organic conductive material to form an organic conductive (OC) layer, as indicated by reference numeral 44, which provides an electrode for an overlying volatilizable, organic photoconductive (OPC) layer 34, described hereinafter. Suitable materials for the OC layer 32 include certain quaternary ammonium polyelectrolytes recited in U.S. Pat. No. 5,370,952, issued on Dec. 6, 1994 to Datta et al. Additionally, an IR absorbing dye, such as nigrosine, pligene blue, tetrabromophenol blue or aminium salts, may be added to the solution that forms the OC layer, to increase the IR absorption thereof. The OC layer has a thickness of about 1 μm, and is air dried.

The OPC layer is formed, as indicated by reference numeral 46, by overcoating the dried OC layer with a solution containing polystyrene; an electron donor material, such as 1,4-di(2,4-methyl phenyl)-1,4 diphenylbutatriene (2,4-DMPBT); electron acceptor materials, such as 2,4,7-trinitro-9-fluorenone (TNF) and 2-ethylanthroquinone (2-EAQ); a surfactant, such as silicone U-7602; and a solvent, such as toluene or xylene. A plasticizer, such as dioctyl phthalate, also may be added to the solution. The surfactant U-7602 is available from Union Carbide, Danbury, Conn.

Figure 4:
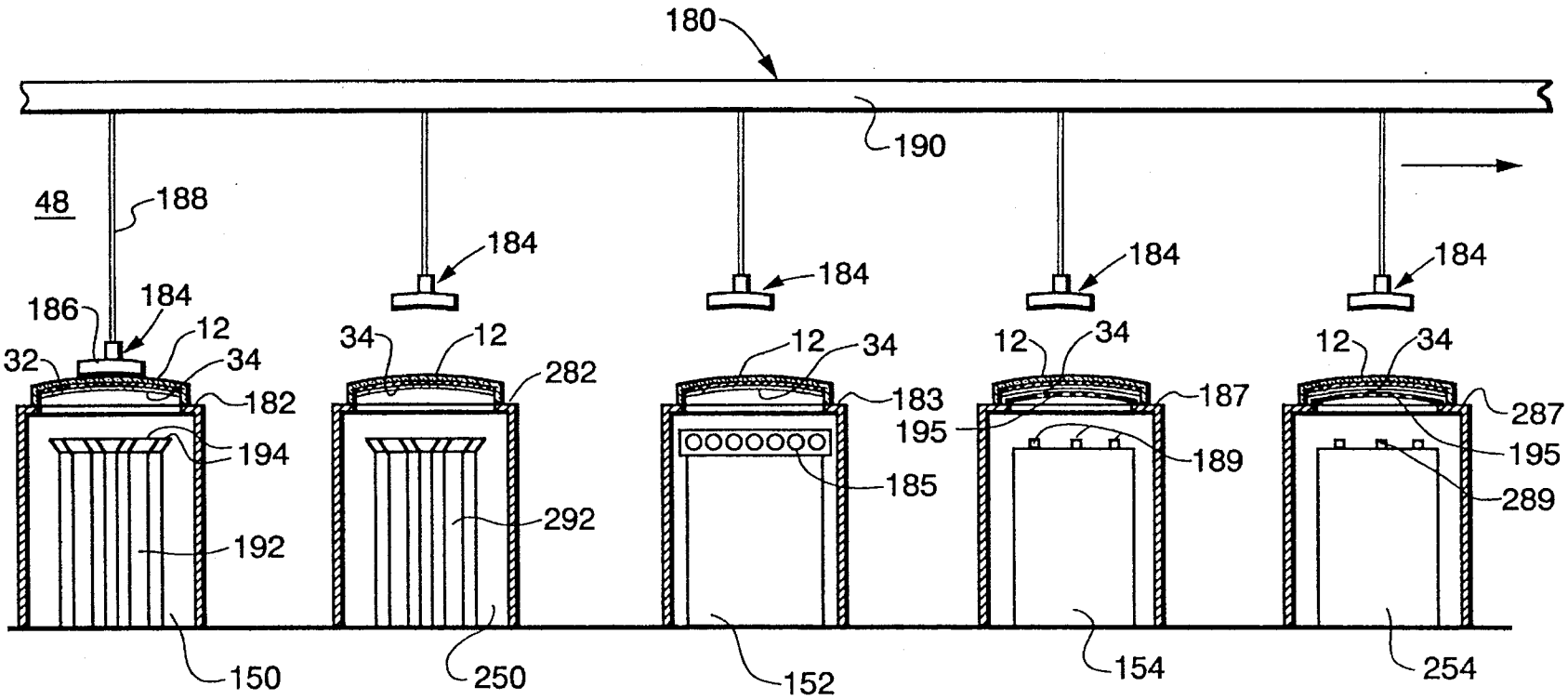
FIG. 4 is a schematic view of the modules and transfer equipment associated with the charge-conditioning portion of the novel process.

According to the present invention, the OPC layer is then charge-conditioned, as indicated by reference numeral 48, to remove excess moisture, including trapped solvents, in order that the OPC layer will adequately accept and retain an electrostatic charge. The novel charge-conditioning process is indicated by steps 50, 52 and 54 of FIG. 3, using the equipment shown in FIG. 4. As indicated by reference numeral 50 in FIG. 3, after the faceplate panel 12 is coated with the OPC solution to form the OPC layer, the panel is transferred by a conveyor 180, shown in FIG. 4, to a first preheat module 150. The panel 12, which at this point in the process is at room temperature (about 21° C.), is placed on an apertured support surface 182 of the preheat module 150, with the OPC layer directed downwardly in order to protect the OPC layer from airborne particles. Transfer devices 184 are utilized in conjunction with the conveyor 180 to move the panels 12 from one module to another. The transfer devices 184 may include, for example, a vacuum holder 186 which contacts and adheres to the outside surface of the panel 12, and a cable 188 which moves along an overhead track 190 of the conveyor 180. The first preheat module 150 includes a gas distribution stack 192 through which warm, dry gas, e.g., air, is directed onto the OPC layer. While air is the preferred gas because of its low cost and safety, nitrogen or any other suitable gases that do not pose a safety hazard may be used. The stack 192 includes a plurality of baffles 194 to substantially uniformly distribute the air over the OPC layer, to drive off excess moisture from the surface of the layer without forming a drying pattern in the layer. The air is warmed, by heating means, not shown, to a temperature of about 40° to 100° C. Better results have been achieved with an air temperature of about 70° to 90° C. The dry air is exhausted from the stack 192 at a velocity of about 152 to 457 meters per minute. For a panel having a diagonal dimension of 51 cm, the preheat, or process time ($t_1$) on module 150 is about 8 seconds. Typically, after the warm air processing on module 150, the OPC layer reaches a first temperature ($T_1$) of about 28° C., while the outer surface of the glass panel is at a second temperature ($T_2$), which is less than about 28° C. The panel 12 is then transferred by means of another transfer device 184 to an apertured support surface 282 of a second preheat module 250, which is identical to the first preheat module 150. The transfer time ($t_2$) from the first preheat module 150 to the second preheat module 250 is about 7 seconds, and the index time ($t_3$), which includes the process time ($t_1$) on module 150 and the transfer time ($t_2$) to the second preheat module 250, is about 15 seconds. The OPC layer on the interior surface of the panel 12 again is preheated, on the second preheat module 250, for about 8 seconds, at 40°–100° C., with warm dry air, or other suitable gas, that passes through a stack 292 at a velocity of 152–457 meters per minute and is uniformly distributed across the layer 34. The temperature ($T_3$) of the OPC layer, after the warm air processing, increases to about 32°–36° C., while the outside surface temperature ($T_4$) of the panel 12 is less than about 30° C.

Next, the OPC layer is exposed to IR radiation as indicated by reference numeral 52 in FIG. 3, by transferring the panel 12, by means of another transfer device 184 to an IR dry/cure module 152. The transfer time ($t_2$) from the second preheat module 250 to the IR dry/cure module 152 is about 7 seconds. The panel 12 is positioned on an apertured support surface 183 so that the OPC layer is directed towards a bank of tungsten—quartz IR lamps 185 disposed within the module 152. Typically, about 18 to 20 of the lamps 185 are used to dry, or cure, the OPC coating on a panel having a 51 cm diagonal dimension. The lamps 185 are available from Research Inc., Eden Prairie, Minn. The OPC layer is dried by exposing the layer to near-infrared (IR) radiation from the lamps 185, which emit radiation between the wavelengths of 0.3 to 6 μm with a near gaussian emission intensity distribution. The process time ($t_1$) on module 152 is about 8 seconds; however, the lamps are at full intensity for an interval ranging from about 3 to 8 seconds. About 80% of the emission of the lamps 185 is within the 0.8 to 3.5 μm region, with a peak intensity at 1.2 μm. The glass faceplate panel 12 absorbs between 30 and 50% of the incident IR radiation below 3.5 μm. The OC layer and the OPC layer, containing the organic materials and the solvents toluene or xylene, absorb about 90 to 100% of the incident radiation between 2.8 and 3.5 μm. The stripes of the matrix 23 also absorb about 80 to 100% of the IR radiation between 0.8–3.5 μm that is transmitted through the OC and OPC layers. Thus, the matrix 23, the OC layer and the OPC layer on the interior of the panel 12 absorb substantial amounts of the incident IR radiation and heat-up rapidly (i.e., in about 8 seconds) to a temperature ($T_5$) within the range of about 50° to 60° C. However, because the radiation is attenuated by the matrix 23, the OC layer and the OPC layer, the panel temperature ($T_6$) increases only slightly, and does not exceed about 33° C. It is estimated that during the IR dry/cure process on module 152, about 6 weight % of the OPC layer is volatilized. It is believed that the weight reduction is due to the removal of solvent from within the bulk of the OPC layer. The removal of this excess solvent from the OPC layer is thought to be necessary to establish an equilibrium condition in which sufficient solvent is retained within the OPC layer to provide the desired electrostatic charge-discharge characteristics and to prevent cracking of the OPC layer, while eliminating excess solvent that inhibits good photoconducting performance.

The panel 12 is next transferred, by means of the transfer device 184, to a first gas-cool module 154. The transfer time ($t_2$) is about 7 seconds, and the process time ($t_1$) on the module 154 is about 8 seconds. The panel 12 is placed on an apertured support surface 187 with the OPC layer directed downwardly. The gas-cool module 154 employs cooled air or another suitable gas that passes through a diffuser 195 and impinges on the surface of the OPC layer to cool the OPC layer sufficiently so that the OPC layer will retain an electrostatic charge. A number of input pipes 189, for example between two and six, distribute the air, which is cooled to a temperature within the range of 5° to 10° C., across the diffuser 195 and onto the OPC layer. The velocity of the air from the pipes 189 is greater than about 1828 meters per minute. In the preferred embodiment, each of the pipes 189 has a 19 mm diameter opening. The rate of cooling of the OPC layer is directly proportional to the number of input pipes utilized, for example, in the present embodiment two pipes are being used. The diffuser 195 has a multiplicity of apertures or openings in the center portion thereof. However, the periphery of the diffuser 195 is imperforate in order to retain the cooling air in the vicinity of the OPC layer. The diffuser 195 is spaced about 12 to 25 mm from the OPC layer. The panel 12 is transferred to an apertured support surface 287 of a second gas-cool module 254, using the transfer devices 184 and air cooled by distributing air through a number of input pipes 289 as described above for the first gas-cool module 154. The transfer time ($t_2$) is about 7 seconds, and the process time ($t_1$) is about 8 seconds. The temperature ($T_7$) of the OPC layer, after air cooling is below 35° C., and preferably ≦30° C. The temperature ($T_6$) of the glass panel, however, does not exceed 33° C. during any of the steps in the charge-conditioning process. Accordingly, the temperature ($T_7$) of the OPC layer and the temperature ($T_6$) of the panel, after the final air cooling step in the charge-conditioning process, are substantially equal to one another, and low enough so that the next step in the manufacturing process can proceed without delay.

The use of the two preheat modules 150 and 250, as well as the two gas cool modules 154 and 254, is merely exemplary, as is the indicated indexing time (which is the sum of the transfer time and processing time). The number of processing units and the index time may be varied to suit the manufacturing conditions, and such changes are within the scope of the present invention.

As indicated by reference numeral 56 in FIG. 3, the OPC layer then is uniformly electrostatically charged using a corona discharge device of the type described in U.S. Pat. No. 5,083,959, issued to Datta et al., on Jan. 28, 1992, which charges the OPC layer a voltage within the range of approximately +200 to +700 volts.

The shadow mask 25 is then inserted into the panel 12, which is placed onto a lighthouse exposure device, as indicated by reference numeral 58, and the positively charged OPC layer is exposed, through the shadow mask 25, to light from a xenon flash lamp or other light source of sufficient intensity, such as a mercury arc, disposed within the exposure device. The light which passes through the apertures in the shadow mask 25, at angles identical to those of one of the electron beams from the electron gun of the tube, discharges the illuminated areas on the OPC layer on which it is incident and forms a charge image. The shadow mask is removed from the panel 12, and the panel is placed onto a first phosphor developer, as indicated by reference numeral 60. A first color-emitting phosphor material is positively triboelectrically-charged within the developer and directed toward the OPC layer. The positively-charged first color-emitting phosphor material is repelled by the positively-charged areas on the OPC layer and deposited onto the discharged areas of the charge image by a process known in the art as "reversal" development. In reversal development, triboelectrically-charged particles of screen structure material are repelled by similarly charged areas of the OPC layer and deposited onto the discharged areas thereof. The size of each of the lines of the first color-emitting phosphor is slightly larger than the size of the openings in the light-absorbing matrix, to provide complete coverage of each opening and a slight overlap of the light-absorbing matrix material surrounding the openings. Because a total of three color-emitting phosphors are required to form the luminescent screen 22, the development, as indicated by reference numeral 62, is not complete. Accordingly, the OPC layer, with the phosphor thereon, is then recharged, light exposed, and phosphor developed, as indicated by reference numerals 56, 58 and 60, respectively, for each of the two remaining color-emitting phosphors. The size of each of the lines of the other two color-emitting phosphors on the OPC layer also is larger than the size of the matrix openings, to ensure that no gaps occur and that a slight overlap of the light-absorbing matrix material surrounding the openings is provided.

When the development of step 62 is complete, the screen 22 is then fixed to the above-described OPC layer, by contacting the phosphors with a suitable fixative, as indicated by reference numeral 64. Next, the screen 22 is filmed, as indicated by reference numeral 66, to provide a smooth surface onto which the aluminum layer 24 is deposited during the aluminizing step, indicated by reference numeral 68. After aluminizing, the screen is baked, as indicated by reference numeral 70, at a temperature of about 425° C., for about 30 minutes, to drive off the volatilizable constituents of the screen assembly.

What is claimed is:

1. In a method of electrophotographically manufacturing a luminescent screen assembly on an interior surface of a faceplate panel for a color CRT, comprising:

forming a photoreceptor on said interior surface of said panel by the steps of coating said interior surface thereof with a volatilizable, organic conductive solution to form an organic conductive (OC) layer; and overcoating said first OC layer with a volatilizable, organic photoconductive solution to form a volatilizable organic photoconductive (OPC) layer; the improvement comprising:

conditioning said OPC layer by directing a stream of warm dry gas onto said OPC OPC layer to warm said layer to a preheat temperature, while maintaining said panel at a panel temperature less than said preheat temperature;

exposing said OPC layer to IR radiation to rapidly increase the temperature of said OPC layer to a curing temperature, greater than said preheat temperature, to remove some of the volatilizable constituents from said OPC layer, without substantially increasing the temperature of said panel; and cooling said OPC layer by directing at least one stream of cool gas onto the surface thereof to lower the temperature of said OPC layer to a subsequent processing temperature.

2. The method as described in claim 1, wherein said stream of dry gas has a velocity of about 152 to 457 meters per minute.

3. The method as described in claim 1, wherein said stream of cool gas has a velocity greater than about 1828 meters per minute which impinges upon a diffuser.

4. The method as described in claim 1, where said preheat temperature is about 32° to 36° C.; said panel temperature is less than about 30° C.; said curing temperature is within the range of 50° to 60° C.; and said subsequent processing temperature is less than or equal to 35° C.

5. The method as described in claim 1, further including, after the cooling step, the steps of:

a) electrostatically charging said OPC layer;

b) exposing selected areas of said OPC layer to light to form a charge image thereon;

c) developing said charged image on said OPC layer by applying a first triboelectrically-charged screen structure material thereto;

d) repeating steps a) through c) for at least two additional triboelectrically-charged screen structure materials to form a luminescent color screen;

e) fixing said screen structure material to said OPC layer;

f) filming said screen;

g) aluminizing said screen; and h) baking said aluminized screen to remove volatilizable constituents therefrom to form said luminescent screen assembly.

6. In a method of electrophotographically manufacturing a luminescent screen assembly on an interior surface of a faceplate panel for a color CRT, comprising:

forming a photoreceptor on said interior surface of said panel by the steps of coating said interior surface thereof with a volatilizable, organic conductive solution to form an organic conductive (OC) layer; and overcoating said OC layer with a volatilizable, organic photoconductive solution to form a volatilizable, organic photoconductive (OPC) layer; the improvement comprising:

conditioning said OPC layer by positioning said panel on a first preheat module and directing a stream of warm, dry air onto said OPC layer for a process time ($t_1$), to warm said OPC layer to a first temperature ($T_1$), while said panel is at a second temperature ($T_2$) less than said first temperature;

transferring said panel in a transfer time ($t_2$) to a second preheat module and directing a stream of warm, dry air onto said OPC layer for a process time ($t_1$), to heat said OPC layer to a third temperature ($T_3$), while said panel is at a fourth temperature ($T_4$);

transferring said panel, in a transfer time ($t_2$) to an IR dry/cure module and exposing said OPC layer, during a process time ($t_1$) to IR radiation to rapidly increase the temperature of said OPC layer to a fifth temperature ($T_5$), greater than said third temperature ($T_3$), to remove some of the volatilizable constituents from said OPC layer, while the temperature of said panel does not exceed a sixth temperature ($T_6$) which is less than said fifth temperature ($T_5$); and transferring said panel, in a transfer time ($t_2$), to at least a first gas-cool module, and cooling said OPC layer by directing at least one stream of cool air onto the surface thereof to lower the temperature of said OPC layer to a seventh temperature ($T_7$) which is substantially equal to said sixth temperature ($T_6$) of said panel.

7. The method as described in claim 6, further including the step of transferring said panel, in a transfer time ($t_2$), to a second cooling module, and cooling said OPC layer by directing at least one stream of cool air onto the surface thereof to stabilize the temperature of said OPC layer at said seventh temperature ($T_7$).

8. The method as described in claim 6, wherein said stream of warm, dry air has a velocity of about 152 to 457 meters per minute.

9. The method as described in claim 6, wherein said stream of cool air has a velocity greater than about 1828 meters per minute, which impinges upon a diffuser spaced from said OPC layer.

10. The method as described in claim 6, wherein said first temperature ($T_1$) is about 28° C.; said first panel temperature ($T_2$) is less than about 28° C.; said third temperature ($T_3$) is about 32° to 36° C.; said fourth temperature ($T_4$) is less than about 30° C.; said fifth temperature ($T_5$) is within the range of 50° to 60° C.; said sixth temperature ($T_6$) is less than or equal to 33° C.; and said subsequent processing temperature ($T_7$) is less than or equal to 35° C.

11. The method as described in claim 6, further including, after the ultimate step, the steps of:

a) electrostatically charging said OPC layer;

b) exposing selected areas of said OPC layer to light to form a charge image thereon;

c) developing said charged image on said OPC layer by applying a first triboelectrically-charged screen structure material thereto;

d) repeating steps a) through c) for at least two additional triboelectrically-charged screen structure materials to form a luminescent color screen;

e) fixing said screen structure material to said OPC layer;

f) filming said screen;

g) aluminizing said screen; and h) baking said aluminized screen to remove volatilizable constituents therefrom to form said luminescent screen assembly.

* * * * *